US007243813B2

(12) United States Patent
Krueger

(10) Patent No.: US 7,243,813 B2
(45) **Date of Patent: *Jul. 17, 2007**

(54) DOMED FOOD CONTAINER

(75) Inventor: Kevin Krueger, Fenton, MO (US)

(73) Assignee: Anchor Packaging, Inc., St. Louis, MO (US)

( * ) Notice: Subject to any disclaimer, the term of this patent is extended or adjusted under 35 U.S.C. 154(b) by 53 days.

This patent is subject to a terminal disclaimer.

(21) Appl. No.: 10/914,298

(22) Filed: Aug. 9, 2004

(65) Prior Publication Data

US 2005/0006391 A1 Jan. 13, 2005

Related U.S. Application Data

(63) Continuation of application No. 09/970,273, filed on Oct. 3, 2001, now Pat. No. 6,786,351.

(51) Int. Cl.
*B65D 1/34* (2006.01)
*B65D 1/32* (2006.01)
*B65D 6/40* (2006.01)

(52) U.S. Cl. ..... 220/571; 220/721; 220/745

(58) Field of Classification Search ..... 220/721, 220/745

See application file for complete search history.

(56) References Cited

U.S. PATENT DOCUMENTS

| | | | | |
|---|---|---|---|---|
| 2,084,084 | A | 6/1937 | Greer | 220/798 |
| 2,207,210 | A | 7/1940 | Von Knauf | 220/799 |
| 2,814,381 | A | 11/1957 | Stevick | 426/129 |
| 2,885,108 | A | 5/1959 | Donoghue | 220/798 |
| 3,090,537 | A | 5/1963 | Pasciak | 220/367.1 |
| 3,912,118 | A | 10/1975 | Bird | 206/508 |
| 3,937,389 | A | 2/1976 | Wind | 229/406 |
| 4,208,006 | A | 6/1980 | Bixler | 229/406 |
| 4,563,561 | A | 1/1986 | Vaeth et al. | 219/735 |
| 4,583,348 | A | 4/1986 | Treiber et al. | 53/441 |
| 4,660,716 | A | 4/1987 | McMahon et al. | 206/216 |
| 4,705,172 | A | 11/1987 | Gage | 206/519 |
| 4,705,588 | A | 11/1987 | Treiber | 53/441 |
| 4,844,263 | A * | 7/1989 | Hadtke | 206/508 |
| D305,409 | S | 1/1990 | Michaud et al. | D9/425 |
| D307,395 | S | 4/1990 | Borst | D9/428 |
| 4,958,479 | A | 9/1990 | Treiber | 53/441 |
| 5,012,061 | A | 4/1991 | Lesser | 219/75 |
| 5,092,479 | A | 3/1992 | Wells | 220/4.23 |
| 5,114,766 | A | 5/1992 | Jacques | 428/35.7 |
| D334,141 | S | 3/1993 | Gottofredi | D9/425 |
| 5,236,119 | A | 8/1993 | Chu | 229/407 |
| 5,259,170 | A | 11/1993 | Tolson | 53/441 |
| 5,269,430 | A | 12/1993 | Schlaupitz et al. | 220/4.23 |
| D342,896 | S | 1/1994 | Gottofredi | D9/425 |
| 5,310,981 | A | 5/1994 | Sarnoff et al. | 219/731 |

(Continued)

*Primary Examiner*—Anthony D. Stashick
*Assistant Examiner*—Shawn M. Braden
(74) *Attorney, Agent, or Firm*—Gallop, Johnson & Neuman, L.C.

(57) ABSTRACT

A food container preferably for heated food, has a lid member and a base member. The base member has complimentary embossed portions in the bottom of the base member to engage a complimentary indented portion in the top surface of the lid member. The retaining mechanism allows containers to be stacked so as to secure each container while allowing steam to escape from the lid of a container. Also, a fluid return system retains fluid in the container and promotes flow of fluid into the bottom of the container.

15 Claims, 14 Drawing Sheets

U.S. PATENT DOCUMENTS

| | | | | |
|---|---|---|---|---|
| 5,335,787 | A | 8/1994 | Finchum et al. | 206/564 |
| D352,454 | S | 11/1994 | Krupa | D9/425 |
| 5,363,978 | A | 11/1994 | Molo | 220/254.3 |
| 5,377,860 | A | 1/1995 | Littlejohn et al. | 220/790 |
| 5,381,901 | A | 1/1995 | Hundley | 206/457 |
| 5,387,781 | A | 2/1995 | Berkoff | 219/735 |
| 5,519,195 | A | 5/1996 | Keefer et al. | 219/728 |
| 5,584,409 | A | 12/1996 | Chemberlen | 220/89.1 |
| 5,603,198 | A | 2/1997 | Rimondi et al. | 53/441 |
| 5,607,709 | A | 3/1997 | Fritz et al. | 426/106 |
| D388,324 | S | 12/1997 | Bonnard | D9/424 |
| D388,699 | S | 1/1998 | Hayes et al. | D91/761 |
| 5,705,213 | A | 1/1998 | Guillin | 426/129 |
| 5,747,084 | A | 5/1998 | Cochran et al. | 426/120 |
| 5,750,967 | A | 5/1998 | Sprauer, Jr. | 219/735 |
| D398,847 | S | 9/1998 | Wyslotsky et al. | D9/425 |
| 5,806,703 | A * | 9/1998 | Grandi | 220/203.15 |
| D400,099 | S | 10/1998 | Brauner | D9/431 |
| 5,887,749 | A | 3/1999 | Schommer et al. | 220/575 |
| 5,897,011 | A | 4/1999 | Brilliant et al. | 220/4.23 |
| 6,119,862 | A | 9/2000 | Childress | 206/557 |
| D432,867 | S | 10/2000 | Oravez | D7/553.4 |
| 6,189,725 | B1 | 2/2001 | Monico | 220/698 |
| 6,257,401 | B1 * | 7/2001 | Mangla et al. | 206/204 |
| 6,259,079 | B1 | 7/2001 | Ji et al. | 219/727 |
| 6,293,692 | B1 | 9/2001 | Bowsher et al. | 366/130 |
| 6,786,351 | B2 * | 9/2004 | Krueger | 220/571 |

* cited by examiner

DOMED FOOD CONTAINER

This Application is a continuation of prior application Ser. No. 09/970,273 filed Oct. 3, 2001 now U.S. Pat. No. 6,786,351.

BACKGROUND OF THE INVENTION

The technical character of the present invention relates in general to food containers used in storing and displaying heated foods and pertains more particularly to chicken roaster containers. The food container of this invention is an improvement over conventional chicken roaster packages in that it features a fluid channel return system and an improved stacking system incorporating a steam escape mechanism in the lid and a retaining mechanism in both the base and in the lid.

Food containers similar to the present invention are often used in scenarios where a person will prepare and sell a food item so that it is prepared and immediately ready to eat. When people purchase food contained in the food containers, oftentimes the containers are not kept in a flat surface such that condensation and oils leak from the container.

A technical problem recognized with respect to conventional food containers relates to leakage of condensation and oils from the container through the seal area. Interlocking arrangements of conventional food containers do not consistently or effectively retain the liquid or prevent condensation or oil from seeping through the interlocking arrangement of a food container.

In addition, with the conventional base and cover combination it is generally necessary to guard against release of steam and hot liquid when removing the cover after heating any food. For example, it is common to place one or more vent openings in the base, the cover, or both in order to allow the escape of steam generated during heating. Conventional food service industry container packaging is often inadequate and does not provide a lid and container that fit together to provide more than minimally acceptable leak resistance. A drawback with conventional food containers includes an inability to provide more than minimally acceptable leak resistance during transportation of the package with heated contents or during the removal of the lid.

Existing lid and container combinations exhibit additional drawbacks, such as lack of acceptable effectiveness with respect to segmented containers, particularly if the food container includes a steam escape feature. A drawback to the steam escape feature exists in either the release of too much or too little steam. If too much steam is allowed to escape from the base and cover combination, then dry food may be the result. Likewise, if steam does not escape from a container, then too much condensation may collect within the container, resulting in food that is too moist.

Another technical problem associated with conventional food containers relates to the loss of liquid from inside the base and cover combination during heating. The heating of the liquid within the base and cover combination may assist the heating process since at least a portion of the heat absorbed by the liquid is transferred to the food. A reduction of this liquid within the base and cover combination could result in food that is not heated to a desired temperature.

Another technical problem associated with conventional food containers is that some containers do not feature a steam escape mechanism. If conventional containers do contain such a mechanism, such a mechanism does not promote or allow containers to be stacked efficiently, such that steam can escape when the containers are assembled and stacked.

Another technical problem associated with conventional food containers is that rarely do food containers contain any kind of mechanism to easily separate the lid from the bottom when the food container is assembled.

Thus, the foregoing solutions to the problem of excess moisture generated during heating of the food in the base and cover combination potentially creates additional problems related to the manner in which the base and cover combination functions and the manner in which the consumer reacts to the heated food. A desirable solution to this and related problems of heating and palatability of the food would provide a mechanism for the release of some liquid and return it back into the base and cover combination.

Accordingly, it is an object of the present invention to provide a food container with improved performance relative to the performance of other food containers for use in heating or transporting foods. With the food container of this invention, food, as well as the condensation and any oils or other liquid from the food, may be retained within the container without accidental leakage. In addition, when the container is assembled, the containers can be stacked in such a way that will reduce the likelihood that the stack of containers will fall. Moreover, when the containers are assembled and stacked, steam may still escape from the stacked, individual containers.

These and other objects and features of the present invention will be better understood and appreciated from the following detailed description of one embodiment thereof and the descriptions of the figures, selected for purpose of illustration and shown in the accompanying drawings.

SUMMARY OF THE INVENTION

Embodiments, including the technical features of the invention for which protection is sought, are illustrated and described herein and include a food container generally comprising a base and a lid, which have the features as herein described. The food container of the present invention addresses the aforementioned technical problems by retaining fluid such as condensation and oil and by promoting the downward flow of the fluid into the base member of the container. When the lid is engaged with the base of the container, the leakage of excess fluid is inhibited by the fluid return system. The fluid return system comprises one or more notches in the upper rim, sidewalls, and a channel in the upper rim of the base member. The positioning of the notches, the location of rib members around the lid member and the base member, and the positioning and variety of heights of the walls in the upper edge rim of the base, promote the retention of fluid within the container.

The present invention also overcomes technical problems found in conventional food containers by allowing steam to escape when containers are assembled and stacked. The containers remain restrained by a retaining mechanism formed into the lid and the base.

The present invention also provides tabs in both the base and the lid of the container to promote easy removal of the lid from the base.

These and other objects and features of the present invention will be better understood and appreciated from the following detailed description of one embodiment thereof, selected for purposes of illustration and shown in the accompanying drawings.

DETAILED DESCRIPTION

Figure 1:
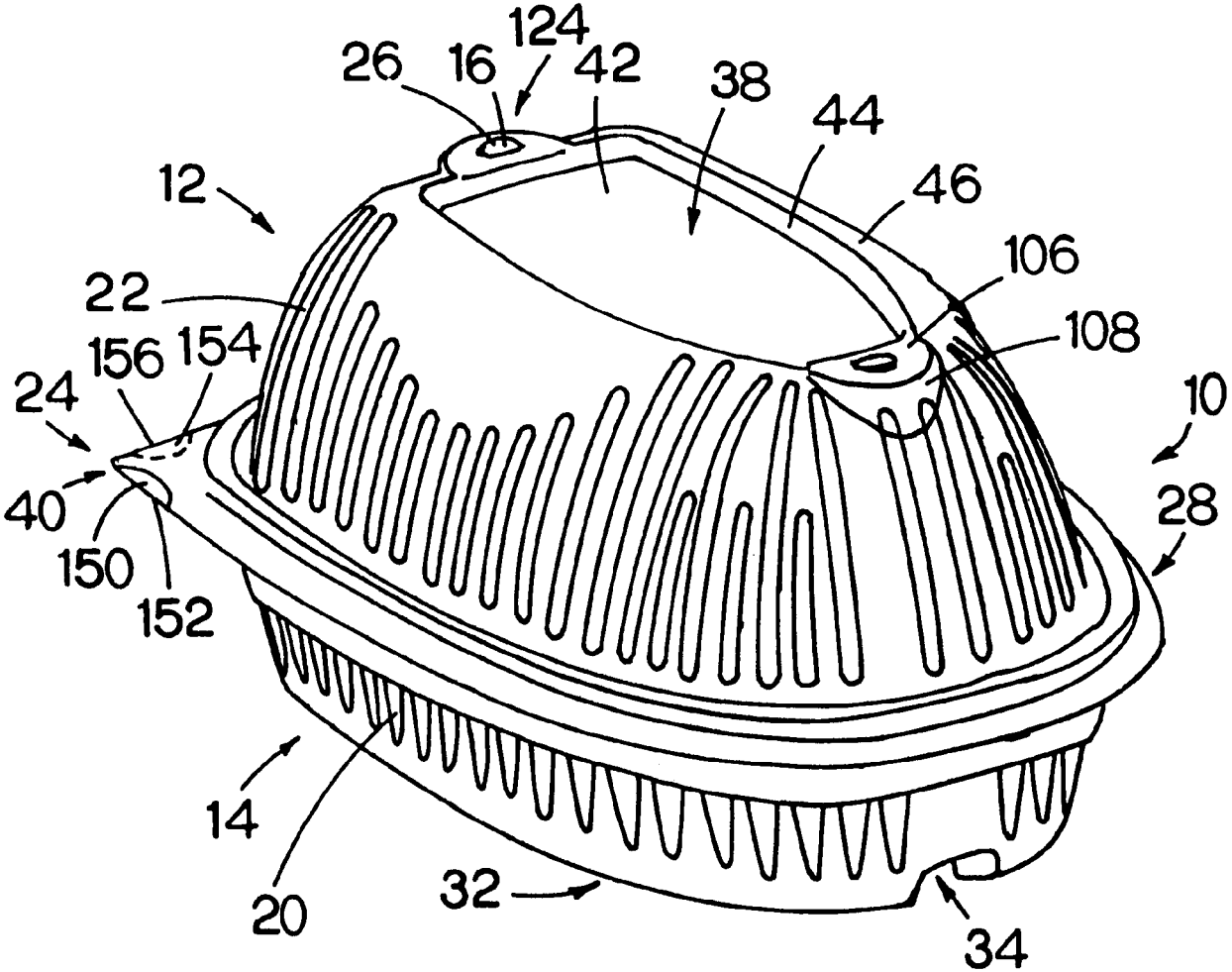
FIG. 1 is a perspective view of the food container of the present invention when the lid member is connected with the base member such that the container is in the assembled state.
Figure 2:
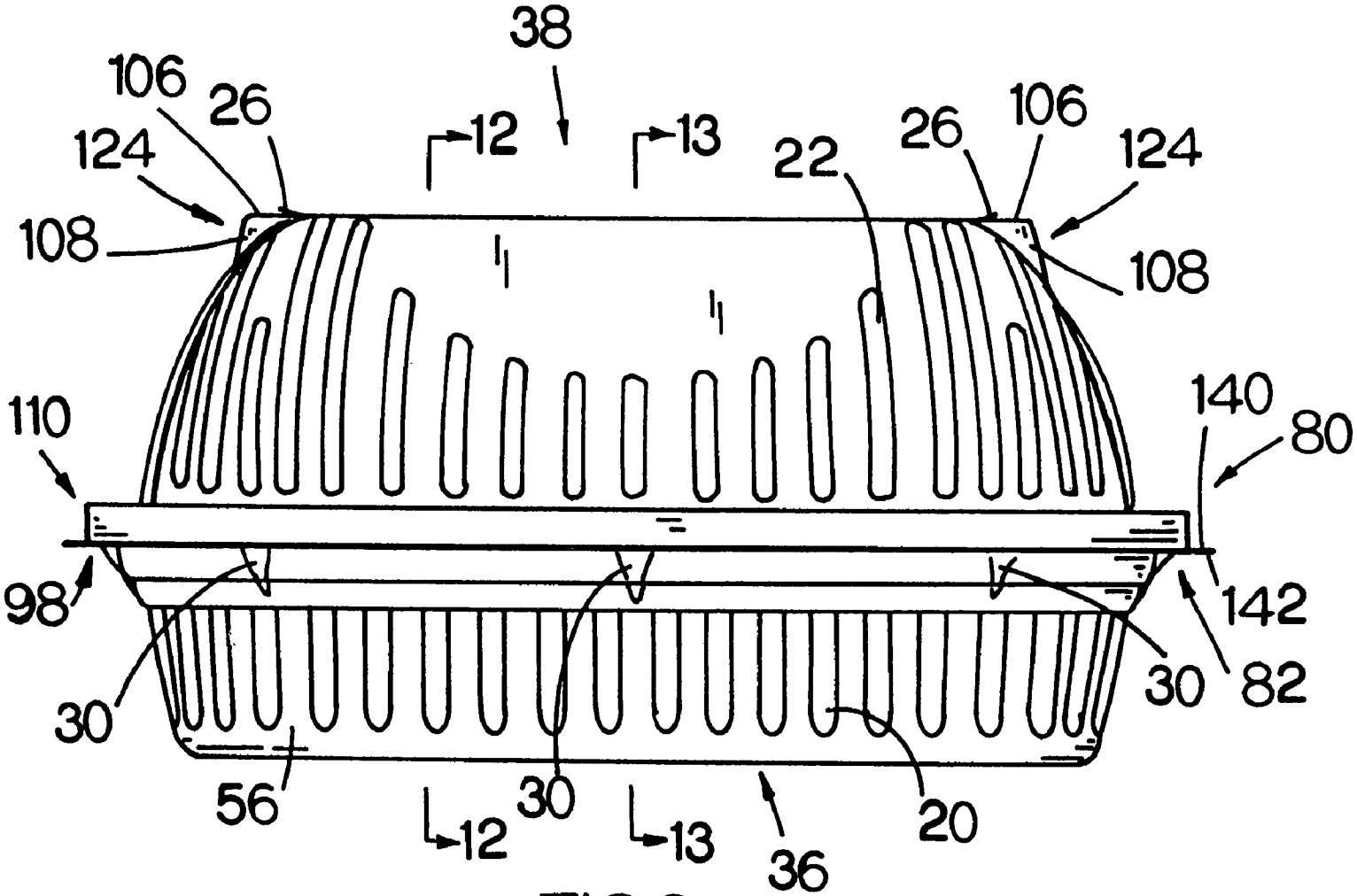
FIG. 2 is a side view of the food container of the present invention when the container is assembled.
Figure 3:
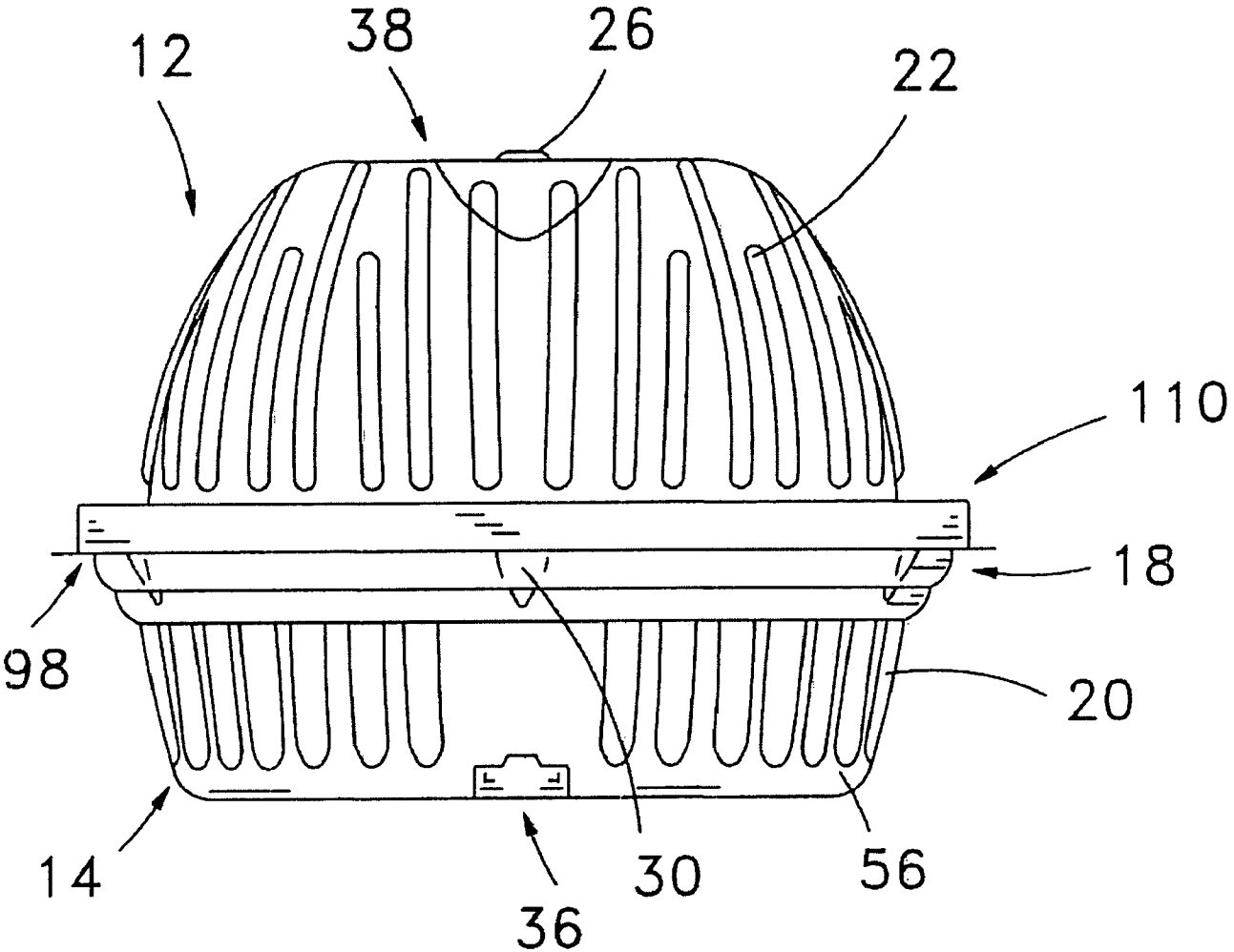
FIG. 3 is another side view of the food container of the present invention when the container is assembled, showing the length of the food container.

Referring now to the drawings, there are shown preferred embodiments for the food container of this invention, including the technical features of the invention for which protection is sought. The food container is described in connection with a chicken roaster where a chicken is prepared and stored in the present invention. The food container has at least two distinguishing features over the prior art, which are a fluid return channel system and a retaining system when containers are stacked. The fluid channel return system comprises a series of channels formed in the upper rim of the base member. The system prevents leakage when the lid member and base member are engaged, and it promotes the downward flow of moisture into the base member. The stacking system features a steam escape feature and a retaining mechanism formed in the lid and the base by a plurality of various height arrangements and a fluid channel return system. The steam escape mechanism allows steam to escape when the containers are stacked and contain either heated or frozen contents.

The drawings show the food container or chicken roaster package 10 generally comprising a lid 12 and a base 14. The chicken roaster package 10 includes a fluid return channel system 18, which generally comprises one or more notches 30 and a plurality of sidewall ribs 20 formed in the sidewall 56. The system may also include a lid member lock rim 110.

The base member bottom comprises a series of channels and ribs such that the food retained in the container is elevated from residual condensation and oils. Specifically, the base member 14 comprises a base bottom 32, sidewall 56, and an upper rim 98, wherein the fluid return channel system is formed into the upper rim 98 and the sidewalls 56. The base bottom also includes a series of channels including at least two outer edge channels 78. The channels 78 and the returning channel 48 cooperate in the base member of the container to retain of any moisture or fluid from the heated food or the condensation formed from food that is defrosting in the container. Each 78 is formed by rib members 54 and 84. Generally, the rib members comprising the uniform rib member 68 and rib members 84 complimentary embossed portions 34, 66, and the retaining mechanism 36 support a food item.

Figure 7:
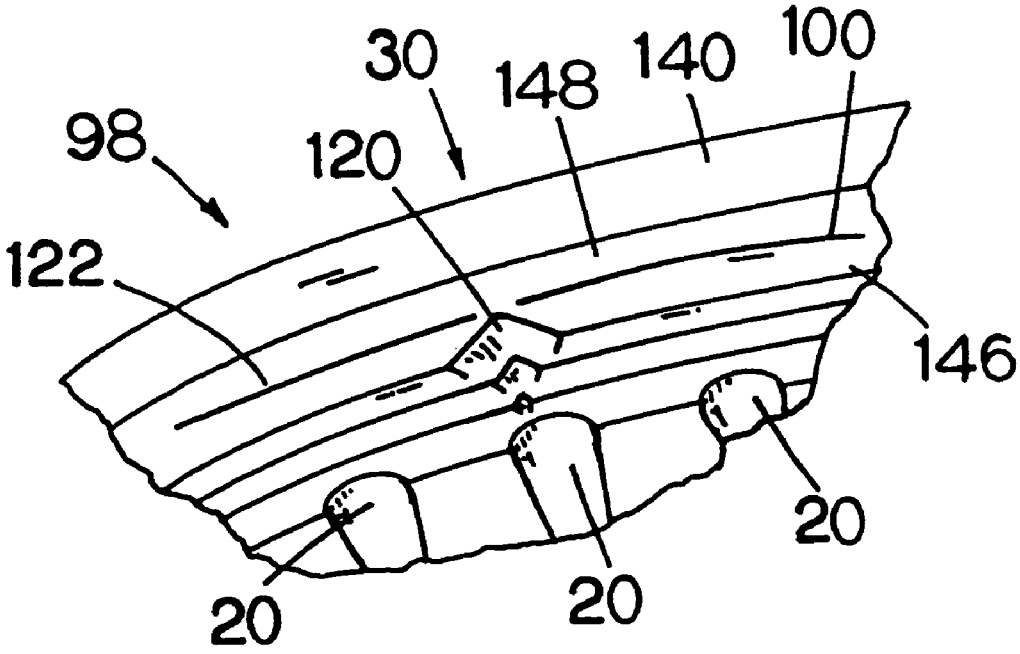
FIG. 7 is a perspective view of the notches that partially form the fluid return channel system of the present invention.
Figure 8:
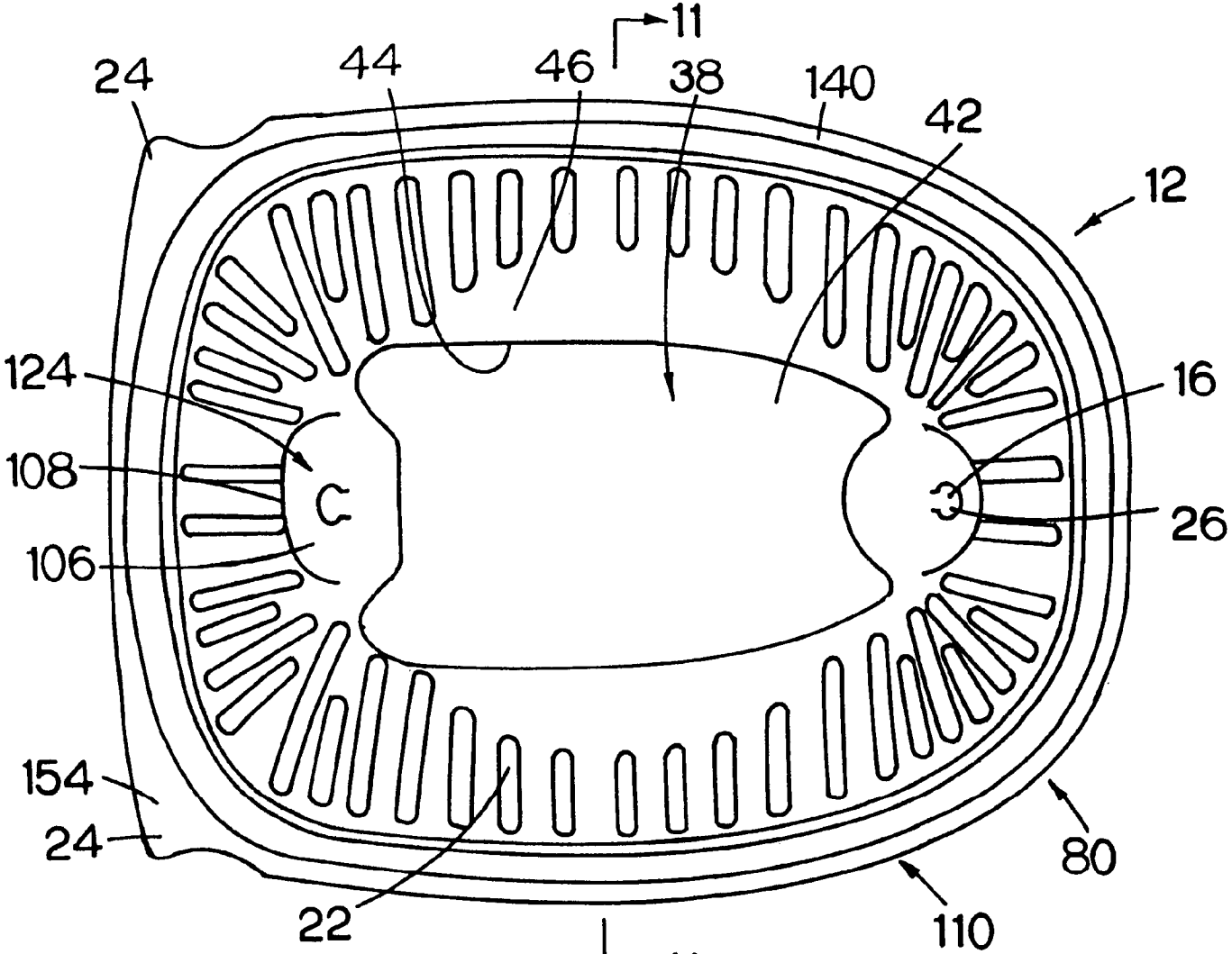
FIG. 8 is plan view of the lid member of the present invention.
Figure 9:
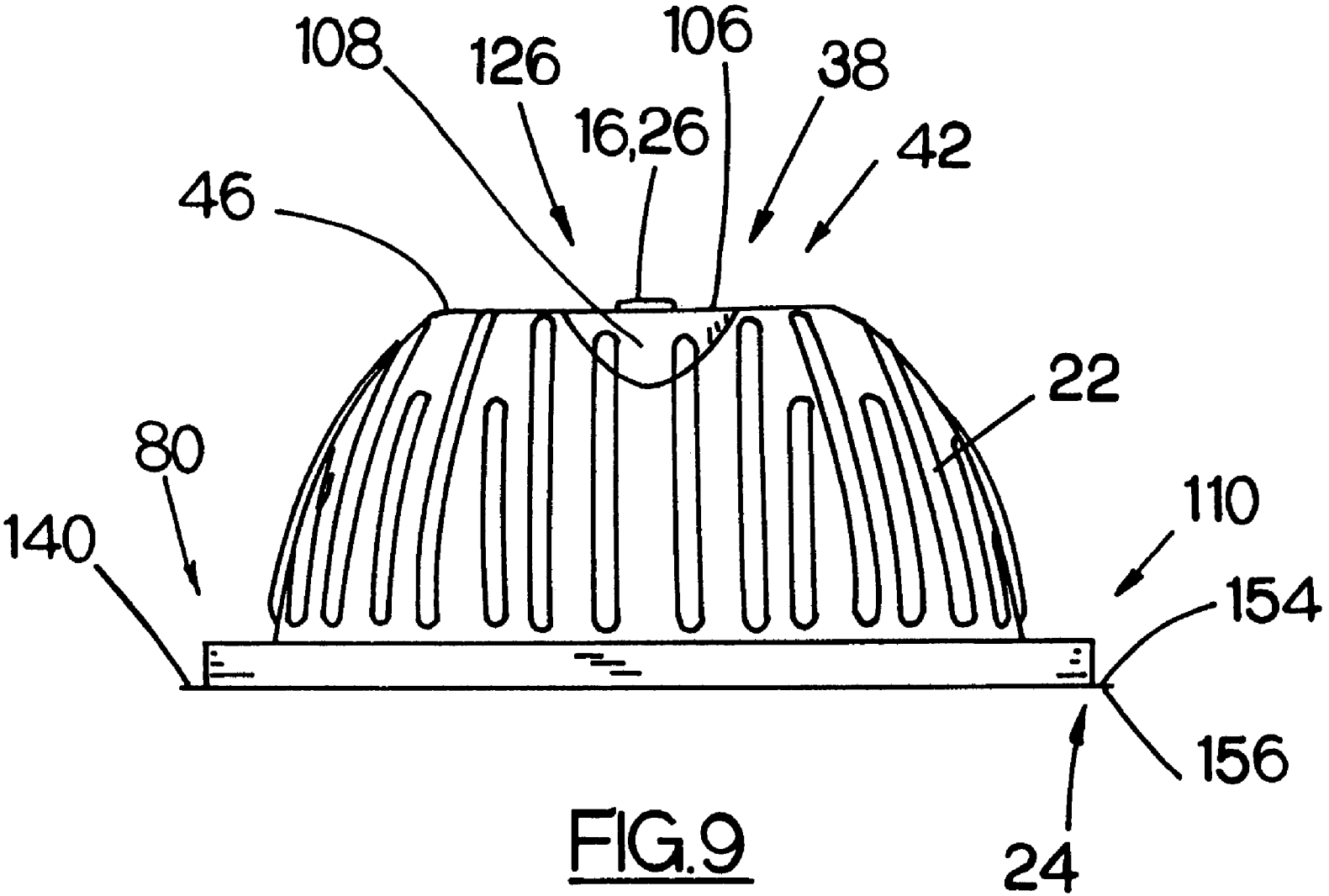
FIG. 9 is a side view of the lid member of the food container.
Figure 10:
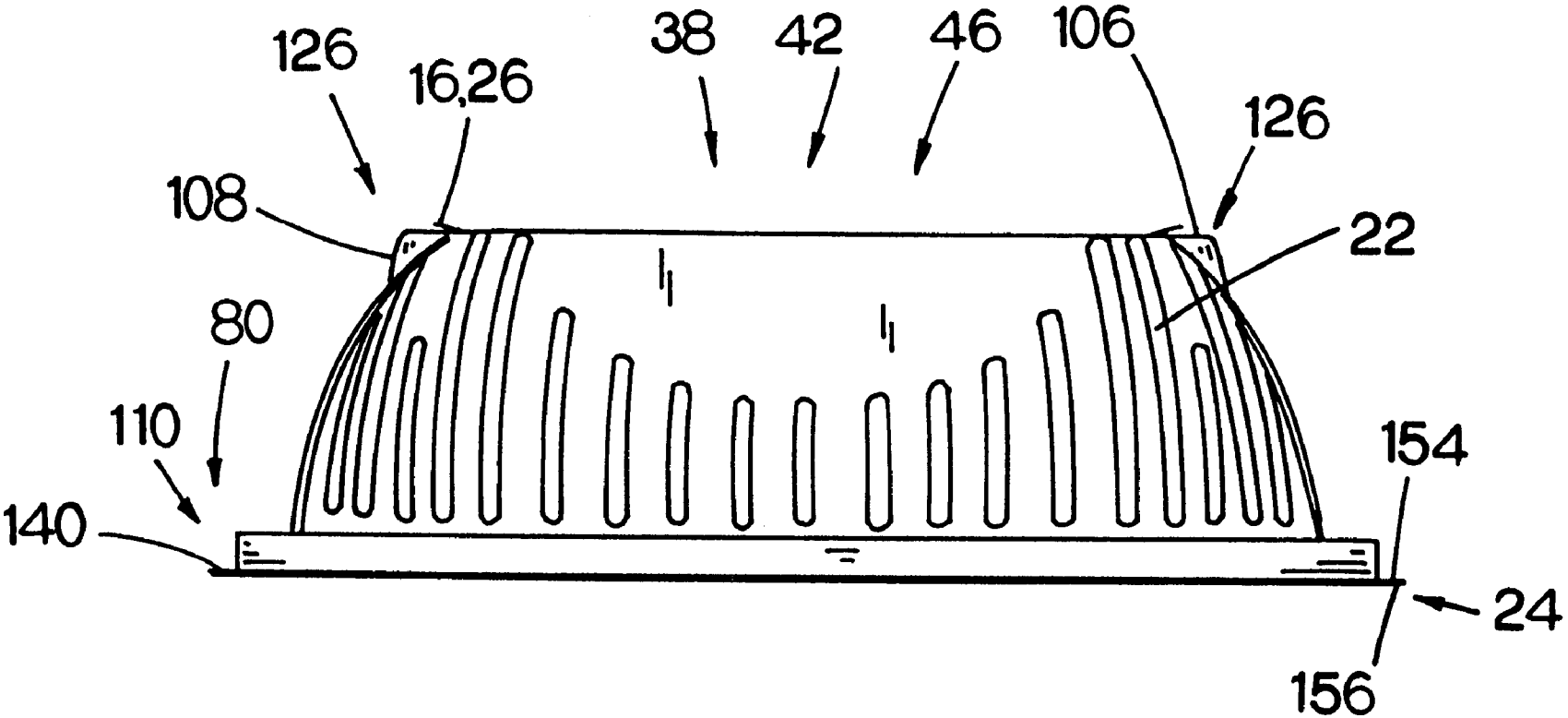
FIG. 10 is another side view of the lid member of the food container, showing the length of the lid member.
Figure 11:
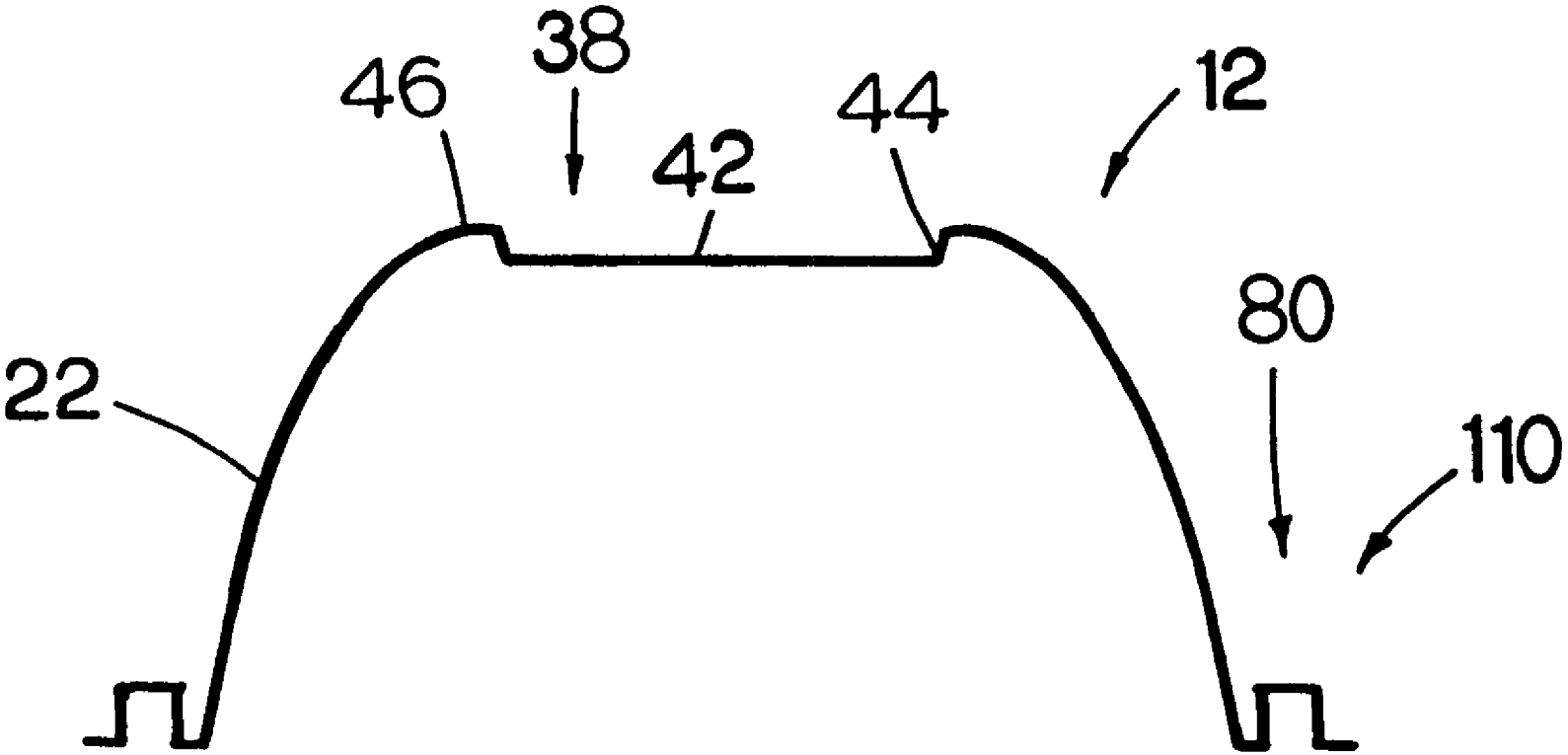
FIG. 11 is a cross-sectional view taken along line 11-11 in FIG. 8.

The fluid return channel system is best shown in the embodiment in FIG. 7. In a preferred embodiment, the fluid return channel 30 comprises two undercuts forming a notch 30 having a vertex 120 in the base member upper rim 98 to promote the downward flow of fluid into the base member bottom, wherein each notch 30 is an acute angle formed in the upper edge of the base member 14. It is understood that the fluid return channel may comprise a notch, as shown and described, or another specific shape or indentation in the base member upper rim 98 that would promote the downward flow of liquid or into the base member as well as the retention of any liquid in the base member of the container.

Figure 4:
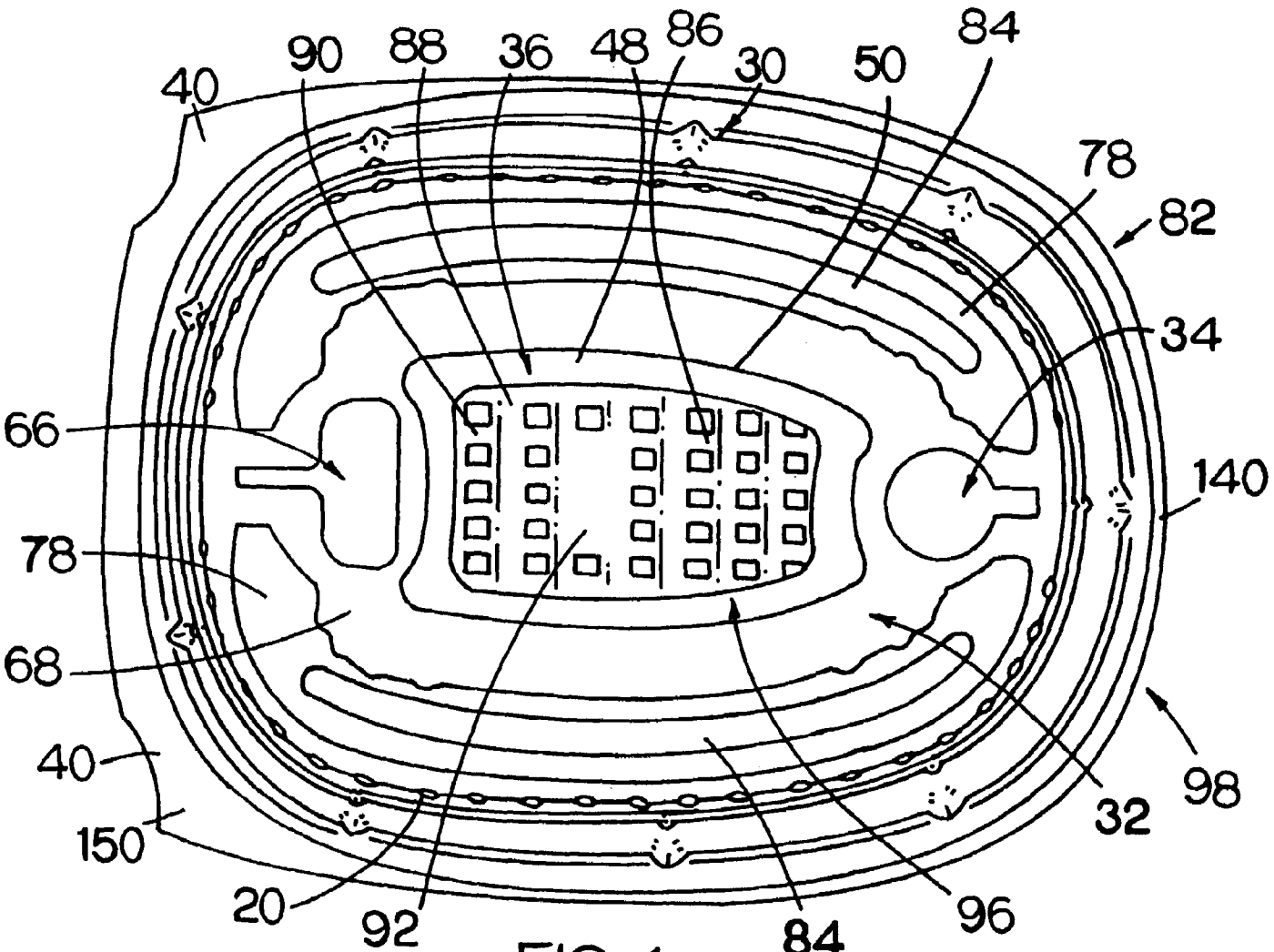
FIG. 4 is plan view of the interior of the base member of the present invention.

In one preferred embodiment of the invention, nine fluid return channels, or notches, 30 are formed into the base member upper rim 98. It is understood by one skilled in the art that any number of these fluid return channels in the base bottom member will promote downward flow of moisture and achieve the desired results of the present invention. FIG. 4 shows the notches 30 placed at various intervals and surrounding the base member upper rim 98. FIG. 7 shows a notch 30 that is formed in the base member upper rim 98 of the base member 14, interrupting the continuous formation of the base member rim 98.

Figure 15:
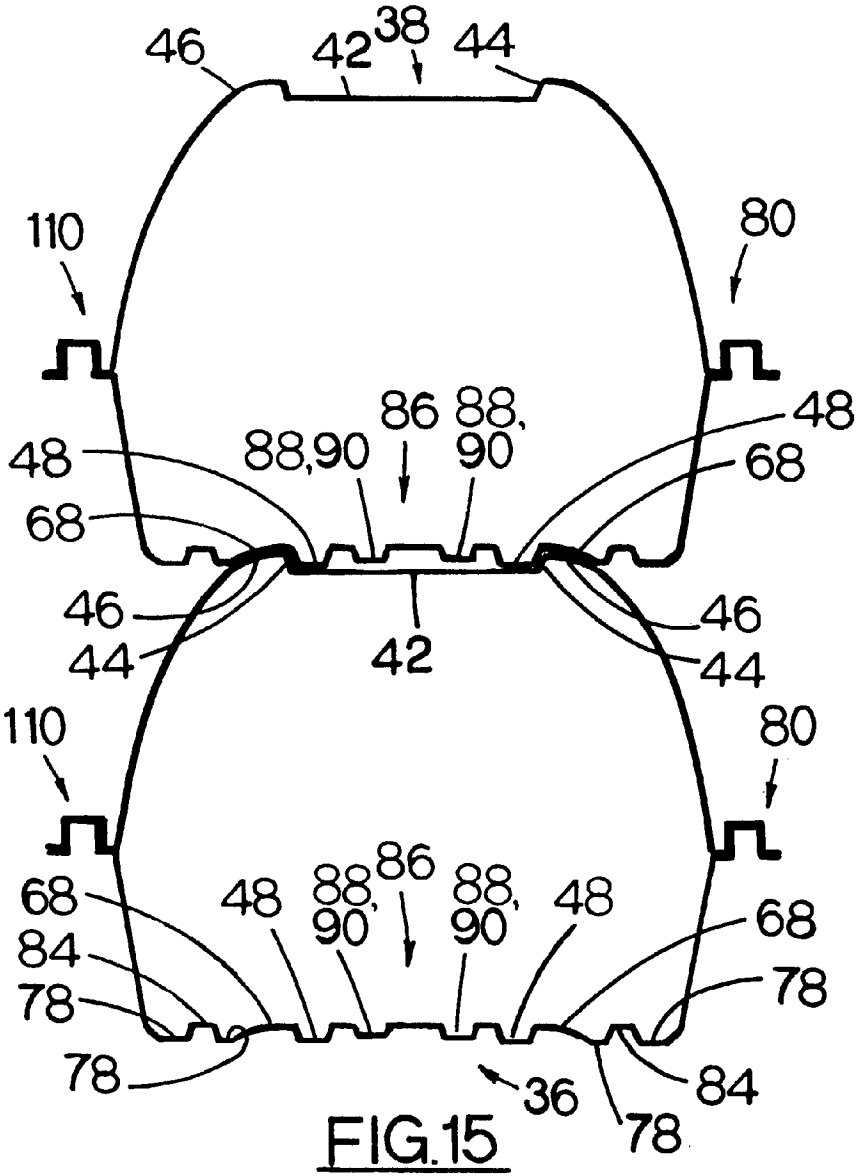
FIG. 15 is another cross-sectional view of two assembled food containers of the present invention when one container is stacked upon the other.

The base member also includes a retaining mechanism 36, which comprises a series of channels and embossed portions, as shown in FIG. 15. More specifically, a series of embossed portions 86 and a series of channels 88, 90 in between the portions 86 form a uniform shape in the base bottom 32. The uniform shape of the retaining mechanism will be complementary to the shape of the lid member retaining mechanism 38. The elevated uniform shape of the raised portions 86 forms a base member retaining inner area 96. In one preferred embodiment illustrated in FIG. 15, the plurality of raised portions 86 act as a gripping mechanism for the food item placed in the container. It is understood, however, that the retaining inner area 96 may comprise a flat surface instead of a plurality of raised portions 86.

The elevated feature of inner area 96 necessarily forms a base member returning channel 48, and the uniform base rib 68 further comprises the retaining feature.

Figure 12:
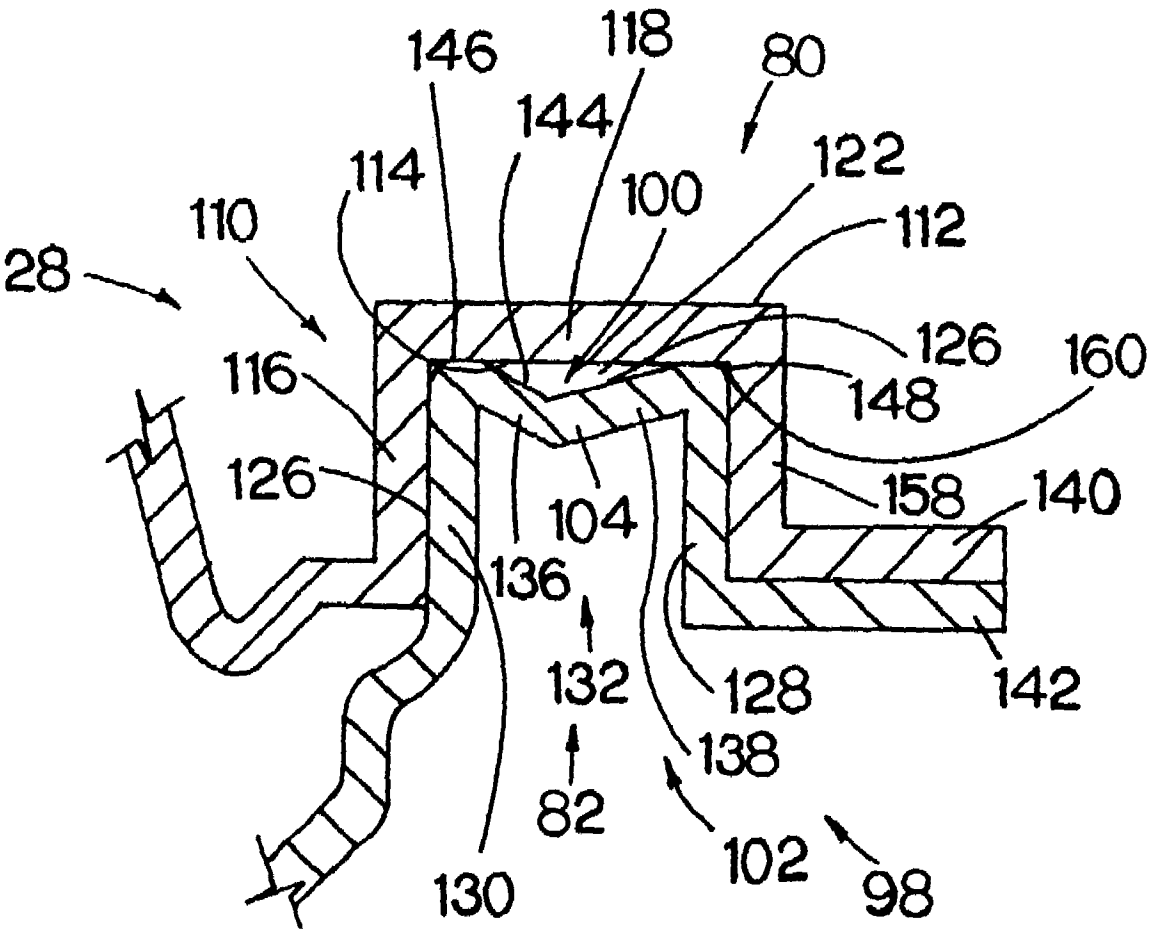
FIG. 12 is a cross-sectional view taken along line 12-12 in FIG. 2.

The base member 14 and the lid member 12 are held together by an interlocking arrangement 28. FIG. 12 shows the interlocking arrangement 28 of the present invention where the base member 14 is engaged with the lid member 12 at a point where the fluid channel return notch 30 is not located. At this section of the container, the base member edge lock rim 102 engages lid member lock rim 110. The base member edge lock rim 102 comprises a base member edge lock rim upper portion 104 and base member interior walls 128, 130. The base member interlocking channel 132 comprises opposing interior walls 128, 130 connected by base member edge lock rim upper portion 104. The base member edge lock rim upper portion 104 is formed by the intersection of base member upper interior walls 136, 138. The intersection of base member upper interior walls 136, 138 also forms a base member rim groove 100 in the upper rim 98.

When the lid member lock rim 110 engages the base member lock rim 102, a sealed channel 122 is formed. The sealed channel 122 may become filled with excess fluid or condensation from the contents of the container. Base member groove 100, however, extends throughout the entire upper rim 98 of the base member 14 and the vertex 120 of the notch 30 promotes the downward flow of liquid to return the liquid back into the base of the container, thereby achieving one of the objects of the present invention.

The lid member lock rim 110 comprises lid member interior sidewalls 116, 158 and lid member lock rim top wall 118, which is connected to each sidewall 116, 158. When the lid member lock rim 110 engages the base member edge lock rim, lid member interior surface 114 contacts base member outer surface 126 at one or more locations.

Figure 13:
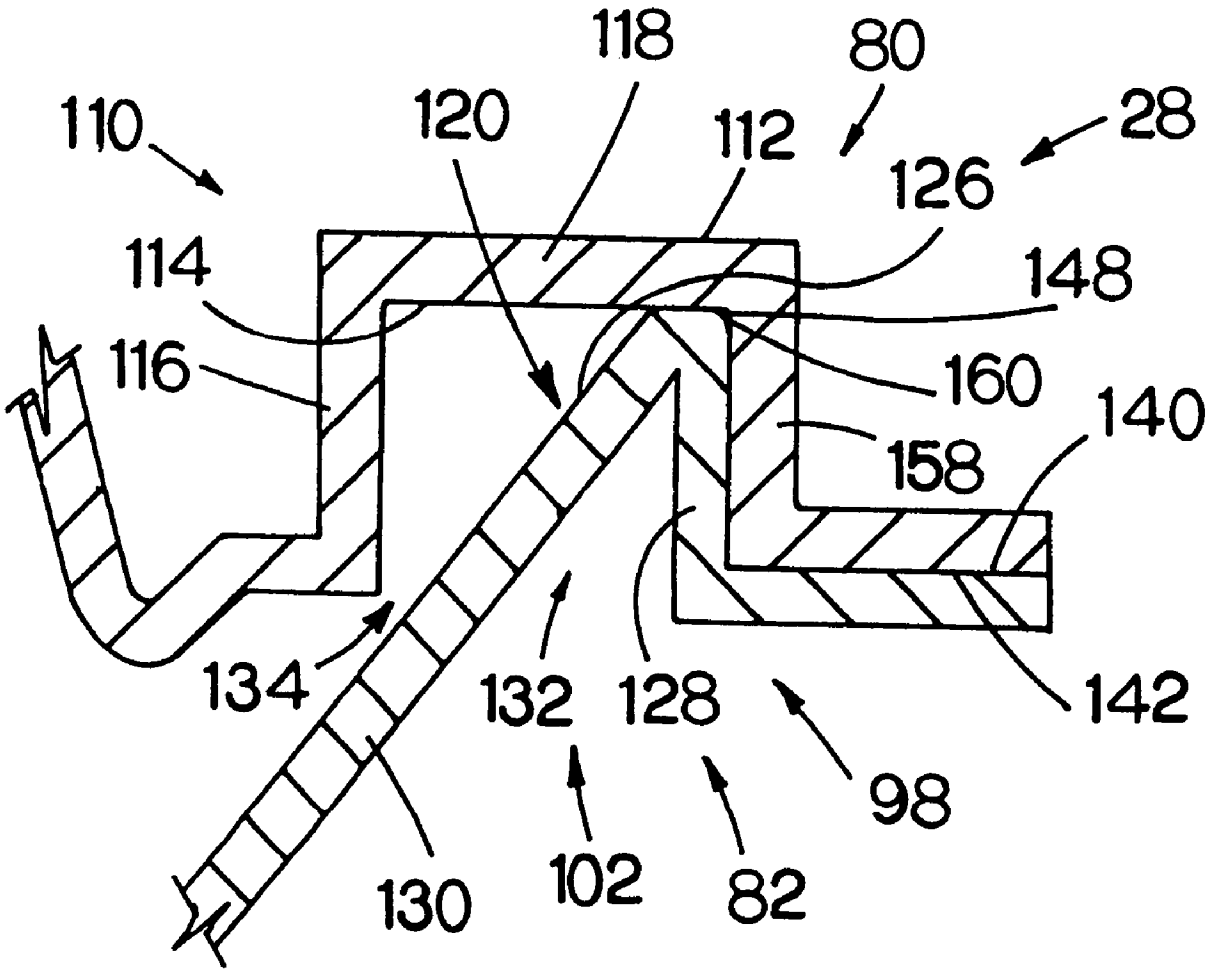
FIG. 13 is a cross-sectional view taken along line 13-13 in FIG. 2.

FIGS. 12 and 13 show the lid member engaged with the base member such that the interlocking arrangement 28 provides a mechanism to engage the base 14 with the lid 12. FIG. 12 shows the interior lips 146, 148 contacting the lid member lock rim top wall 118. The interior lip 146 is formed by the intersection of one of base member interior sidewall 130 and base member upper interior wall 136. The surface of corner 146 contacts the lid member inner surface 114, likewise, exterior lip 148 is formed by the intersection of base member interior side wall 128 and base member upper interior side wall 138.

The perspective view of FIG. 12 shows the interior lips 146, 148 such that the points of contact generally between the base member base member interlocking means 82 and the lid member interlocking means 80, specifically, the lid member lock rim top wall 118, occur at two locations. The base member outer surface 126 contacts the interior sidewalls 116, 158. These various points of contact generally form the seal of the lid member 12 to the base member 14, and more particularly, form the sealed channel 122 of the base member. Fluid may collect in the sealed channel 122 and fill the channel. The fluid return channel system, however, promotes the flow of any liquid into the container such that the channel 122 should not retain any substantially amount of collected moisture.

FIG. 13 shows the section view of the fluid return notch 30 at the vertex 120. In this section of the container, the vertex 120 of the notch 30 generally promotes the flow of liquid from an upper portion of the base member rim 98, specifically in the sealed channel 122 to the bottom of the base.

FIG. 13 also shows fluid flow channel 134, which is formed by an opening between the base member upper rim 98 and the lid member lock rim 110 and allows the fluid to flow back into the container. In this embodiment, the base member upper exterior surface 126 is a diagonal portion, which comprises vertex 120 of the notch 30. The base member interlocking channel 132 is formed by the intersection of the two base member interior walls 128, 130.

Also, it is shown that the base member edge lock rim 102 and the lid member lock rim 110 contact each other at several locations. First, base member interior wall 128 contacts lid member interior wall 158 and lid member outer edge 140 comes in contact with base member outer edge 142. In addition, exterior lip 148 contacts the lid member inner surface 114 at a lid member lock rim corner 160. The absence of an upper portion of the base member lock rim forms a fluid flow channel 134, which allows and promotes the flow of any excess fluid into the base of the container.

The retaining mechanism of the present invention is formed in both the base member 14 and the lid member 12. The retaining mechanism of the base member generally comprises a series of channels and embossed portions, and has a uniform shape so as to effectively retain the lid member 12 of a separate food container located under the base member 14. The base member retaining mechanism 36 comprises a series of embossed portions 86, which form intersecting channels 88, 90. In a preferred embodiment, the raised portions have a square shape and are formed into the base bottom 32, and add a gripping feature to the base member 14.

Figure 5:
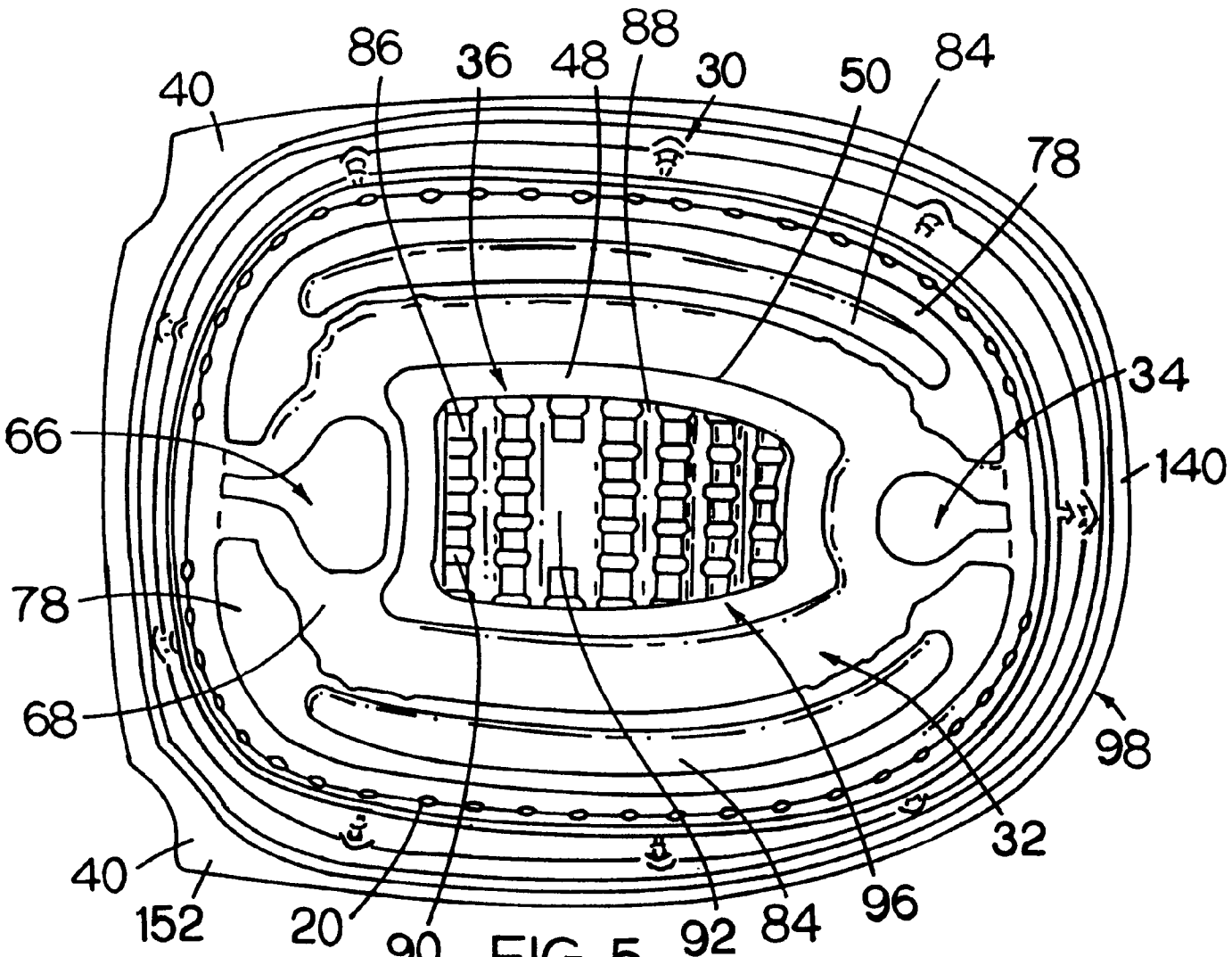
FIG. 5 is plan view of the exterior or bottom of the base member of the present invention.

The retaining mechanism 36 is elevated from the base bottom 32, such that fluid in channels 88, 90 flows downward into the retaining channel 48. FIG. 5 shows that the channels are formed in the base member 14 such that channel 88 is at a slightly lower level than channel 90. The level of the channels may vary to promote the downward flow of fluid into the outer edge channels 78, 52.

The retaining mechanism 36 may also include a region 92 in approximately the same plane as the channels 88, 90 so that a manufacturer could include a trademark or other type of writing or design in the base member 14. Similarly, writing could be formed into the base member at any desired location.

The retaining mechanism 38 of the lid member generally has a complementary uniform shape to the base member retaining mechanism 36 and further comprises an embossed portion in the upper surface 46 of the lid member 12. The retaining mechanism 38 comprises the lid member upper surface 46, lid member retaining sidewall 44, and embossed retaining surface 42.

When the base member 14 of a container is stacked on a lid member 12 of another container, the containers generally come in contact at two or more locations. First, retaining sidewall 44 contacts the base member retaining exterior sidewall 50, and the lid member retaining surface 42 contacts the base member retaining channel 48. In addition, the embossed retaining surface contacts the base member retaining channel 48. Base member inner retaining channel 48 comprises a channel having a uniform shape, which is uninterrupted by any embossed portions or ribs. Also, the lid member upper surface 46 contacts the uniform rib 68.

The lid member also contains steam escape openings 16 formed in a vented extension 124 as shown and described herein. The extension 124 is formed in the container and comprises a vented extension wall 108 and an upper surface or platform 106. In a preferred embodiment, the extension wall 108 is rounded. A flap 26 is formed in the upper surface 106, which creates a vented opening 16. The lid member also includes a plurality of ribs 22.

Figure 6:
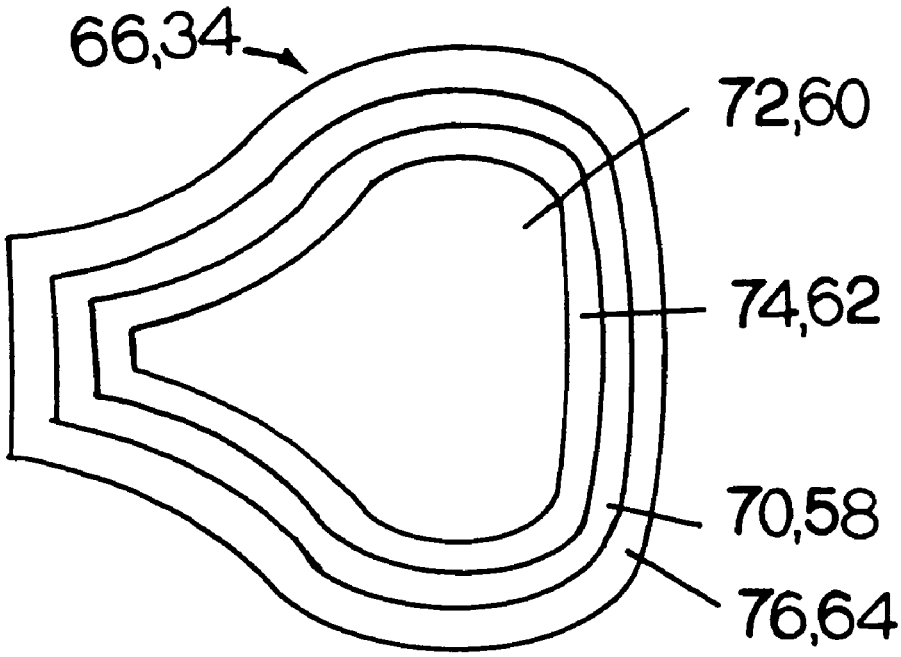
FIG. 6 is plan view of a complimentary embossed portion in the base member.
Figure 14:
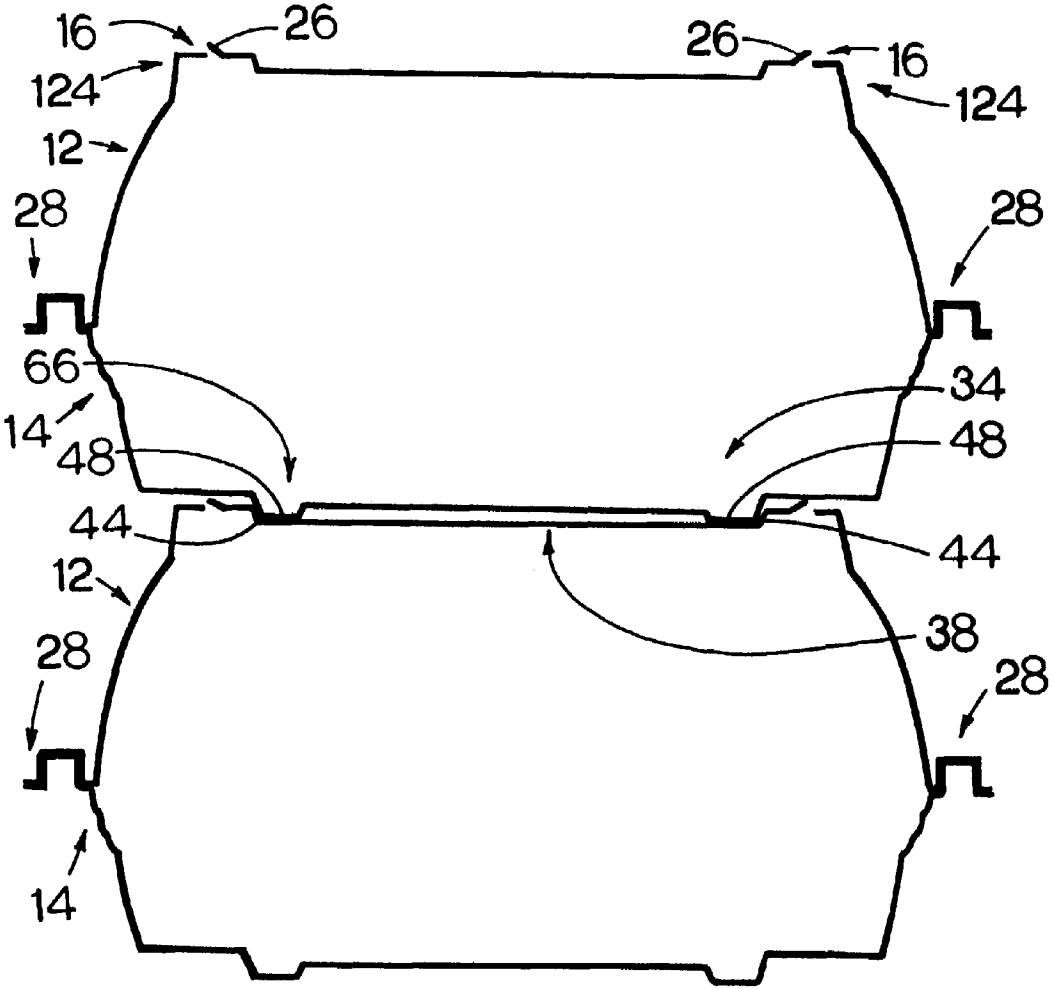
FIG. 14 is a cross-sectional view of the length of two assembled food containers of the present invention when one container is stacked upon the other.

The base member also includes at least two complementary base member embossed portions 34, 66 that partially comprise the retaining system. The three layer surface composition of the base member embossed portions 34, 66 is shown in FIG. 6. In the preferred embodiment of the present invention, the embossed portions 34, 66 have different shapes that correspond with the shape of the food container 10, which is intended to store a chicken. These embossed portions correspond with the vented extension 124 so steam can escape from the openings 16 when a container is stacked on top of another, as shown in FIG. 14.

The two embossed portions 34, 66 shown in FIG. 6 comprise a plurality of incremental surfaces and transition portions, wherein each base member embossed portion 34, 66 comprises three surfaces: a base bottom inner surface 56, 68, a base member embossed portion intermediate surface 58, 70, and a base member embossed upper surface 60, 72. Intermediate surfaces 58, 70 comprise the base member uniform rib 68.

Transition portions connect the various surfaces, and comprise upper embossed transition portion 62, 74 and a lower embossed transition portion 64, 76. The lower embossed transition portions 64, 76 comprise sidewalls and form part of the base member returning channel 48.

In a preferred embodiment, the upper surface 72 is at a location higher than the retaining mechanism in the base bottom member 36 of the base 14. Therefore, the food held within the present invention initially contacts the base member embossed portion upper surface 60, 72. Both transition portions 62, 74 and 64, 76 allow and promote the flow of juice and fluid from a chicken, for example, held within the food container 10 to flow to the bottom of the base 14.

The three layer embodiment of the base member embossed portion 34 and 66 allows the base member retaining mechanism 36 and the complementary lid member retaining mechanism 38 to effectively remain engaged while steam escapes from the vented lid member openings 16. The lid member flaps 26 may contact the upper surface 60, 72 of the embossed portions 34, 66 when the containers are stacked, as shown in FIG. 14.

The present invention also includes one or more tabs in the lid member 12 and in the base member 14. Lid member tabs 24 are formed by cut-outs from the lid member outer edge 140. The lid member tab 24 includes an upper surface 154 and a lower surface 156 that remain exposed. Likewise, a tab 40 in the base member 14 comprises an upper surface 150 and a lower surface 152. The shape of tabs 40 in the rim outer edge 142 are such that the upper surface 150 remains uncovered by the lid member outer edge 140 when the lid member and base member are engaged by the interlocking arrangement 28.

In operation, each lid member 12 retains the base member 14 by retaining the base member retaining mechanism 36. The lid member retaining mechanism 38 is formed in the lid member in a shape complementary to the general shape of the base member retaining mechanism 36. The lid member retaining mechanism 38 is formed by an embossed retaining surface 42, a retaining sidewall 44, and upper surface 46. The base member retaining mechanism 36 is formed by a plurality of raised portions 86 that comprise an inner area 96 having a uniform shape. The retaining mechanism also includes a uniform base rib 68, wherein the base rib 68 and the inner retaining area 96 form a retaining channel 48.

Generally, the height of lid member sidewall 44 and corresponding base member retaining exterior sidewall 50 have a uniform shape and determines the effectiveness of the retaining mechanism. In one preferred embodiment, the height of the retaining sidewall 44 ranges from ⅛ inch to ½ inch where the engaging mechanism of each the base member and the lid member has a uniform shape; therefore, the height of the respective sidewall is uniform throughout. Accordingly, the engaging mechanism exterior sidewall 50 will range from approximately ⅛ inch to ½ inch, enabling the base member engaging 36 to be effectively retained within the lid member retaining mechanism 38.

When the lid member retaining mechanism 38 is engaged with the base member retaining mechanism 36, the lid member flaps 26 may contact the upper surface of the embossed portion 60, 72.

Having described the invention in detail, those skilled in the art will appreciate that modifications may be made of the invention without departing from its spirit. Therefore, it is not intended that the scope of the invention be limited to the specific embodiment illustrated and described. It is not intended that the scope of the invention be limited to the specific embodiments illustrated and described.

The invention claimed is:

1. A food container comprising:

a lid member, the lid member including an upper surface and including a retaining mechanism formed in the upper surface of the lid member;

the lid member retaining mechanism including one or more steam escape mechanisms;

a base member having a base bottom, the base member including a base member retaining mechanism formed into the base bottom and including one or more steam escape mechanism engaging portions;

the base member retaining mechanism being complementary with the lid member retaining mechanism, whereby at least one of the steam escape mechanisms is complementary with one of the steam escape mechanism engaging portions;

the lid member and base member being capable of interlocking arrangement such that the lid member can be removably secured to cover the base member; and wherein when the container is arranged in stacked formation below an identical container, at least one of the steam escape mechanisms of the lid member retaining mechanism engages one of the steam escape mechanism engaging portions of the base member retaining mechanism on the container above it and steam can escape the food container through an engaged steam escape mechanism.

2. The food container as set forth in claim 1, wherein the base member further comprises sidewalls, an upper rim, and a series of channels.

3. The food container as set forth in claim 1, wherein the base member retaining mechanism further comprises a uniform shape in the base bottom including a plurality of embossed portions and channels.

4. The food container as set forth in claim 1, wherein the base member retaining mechanism further comprises a uniform shape including a retaining inner area having a flat surface.

5. The food container as set forth in claim 1, wherein the base member retaining mechanism further comprises a uniform rib in the base member, whereby when the container is arranged in stacked formation on top of another identical container, the rib member contacts the upper surface of the lid member of the container below it.

6. The food container as set forth in claim 1, wherein at least one of the steam escape mechanism engaging portions are embossed portions.

7. The food container as set forth in claim 6, wherein one or more of the steam escape mechanism engaging portions comprises a plurality of elevated and incrementally spaced surfaces formed in the base member.

8. The food container as set forth in claim 6, wherein the steam escape mechanism engaging portions are formed by a base bottom inner surface, a base member embossed portion intermediate surface, and a base member embossed upper surface.

9. The food container as set forth in claim 1, wherein at least one of the one or more steam escape mechanisms comprises a steam escape opening formed in a vented extension of the lid member.

10. The food container as set forth in claim 9, wherein one or more of the vented extensions comprise a vented extension wall and an upper surface.

11. The food container as set forth in claim 9, wherein one or more of the steam escape mechanisms are formed by flaps in a vented extension.

12. The food container as set forth in claim 1, wherein tabs are formed by cut-outs in an outer edge of the lid member and in an outer edge of the base member.

13. The food container as set forth in claim 1, wherein the lid member retaining mechanism further comprises an embossed surface and a sidewall formed in the upper surface of the lid member.

14. A food container comprising:

a lid member, the lid member including an upper surface and including a lid member retaining mechanism formed in the upper surface;

the lid member retaining mechanism including one or more vented extensions, an embossed surface and a sidewall;

a base member including a base bottom and a base member retaining mechanism formed into the base bottom;

the base member retaining mechanism including one or more embossed portions and being complementary with the lid member retaining mechanism;

the lid member and base member being capable of interlocking arrangement such that the lid member can be removably secured to cover the base member; and wherein when the container is arranged in stacked formation below an identical container, one or more vented extensions of the lid member retaining mechanism are complementarily engaged by the one or more embossed portions of the base member retaining mechanism on the container above it and steam can escape the food container through one of the engaged vented extensions.

15. A food container comprising:

a lid member, the lid member including a lid member retaining mechanism formed in the upper surface of the lid member, wherein the lid member retaining mechanism includes an embossed surface, a sidewall, and one or more vented extensions;

a base member including a base member lock rim and including a base member retaining mechanism including a retaining inner area having a flat surface and one or more embossed portions having a plurality of elevated and incrementally spaced surfaces;

the base member retaining mechanism being complementary with the lid member retaining mechanism such that when the container is arranged in stacked formation below an identical container, one or more vented extensions of the lid member retaining mechanism are complementarily engaged by the one or more embossed portions of the base member retaining mechanism on the container above it; and an interlocking arrangement in the lid member and the base member that secures the base member with the lid member to form the container.

* * * * *